United States Patent [19]

Muramatsu

[11] Patent Number: 4,908,673

[45] Date of Patent: Mar. 13, 1990

[54] IMAGE FORMING APPARATUS HAVING A PAPER REFEED TRAY

[75] Inventor: Hideo Muramatsu, Osaka, Japan

[73] Assignee: Minolta Camera Kabushiki Kaisha, Osaka, Japan

[21] Appl. No.: 259,781

[22] Filed: Oct. 19, 1988

[30] Foreign Application Priority Data

Oct. 19, 1987 [JP] Japan ..... 62-263210
Oct. 19, 1987 [JP] Japan ..... 62-263211
Oct. 19, 1987 [JP] Japan ..... 62-263212
Oct. 19, 1987 [JP] Japan ..... 62-263213

[51] Int. Cl.[4] ..... G03G 15/00

[52] U.S. Cl. ..... 355/311; 355/319; 355/24; 271/3.1; 271/171; 271/227

[58] Field of Search ..... 355/24, 26, 311, 319, 355/321; 271/3.1, 227, 238–240, 250, 253, 261, 265, 221, 223, 171

[56] References Cited

U.S. PATENT DOCUMENTS 4,585,336 4/1986 Tanaka ..... 355/319
4,657,239 4/1987 Ikesue et al. ..... 271/227
4,660,963 4/1987 Stemmle ..... 355/24

FOREIGN PATENT DOCUMENTS 65-254431 11/1986 Japan .

*Primary Examiner*—Joan H. Pendegrass
*Attorney, Agent, or Firm*—Burns, Doane, Swecker & Mathis

[57] ABSTRACT

When paper where an image has been formed is stored in a paper refeed tray in a duplex or composite copy mode, two first regulator plates, between which the paper exists, move toward the paper to regulates a dimension of the paper in a direction perpendicular to a paper feeding direction. Each of the two first regulator plates has a detection member for detecting contact with paper. When the detection members of the two regulator plates provide detection outputs, the movement of the two regulator plates is stopped. Meanwhile, a passing time of the paper fed to the paper refeed tray is measured at a predetermined position. Based on the result of the measurement, a position of a second regulator plate for regulating the paper stored in the paper refeed tray in the paper feeding direction is controlled.

14 Claims, 18 Drawing Sheets

IMAGE FORMING APPARATUS HAVING A PAPER REFEED TRAY

BACKGROUND OF THE INVENTION

1. Field of the Invention

The present invention relates to an image forming apparatus and particularly to an image forming apparatus having a paper refeed tray and being capable of performing duplex copy and composite copy.

2. Description of the Prior Art

Copying apparatus capable of performing duplex copy and composite copy have been proposed in the prior art.

The duplex copy and the composite copy are copy operation as described below. After a first image is formed on one surface of paper fed to an image forming portion, the paper is not discharged outside the copying apparatus and it is temporarily stored in a refeed tray. Then, it is refed to the image forming portion and a second image is formed on the same surface of the paper (in the case of the composite copy) or on the opposite surface of the paper (in the case of the duplex copy).

In either of the two cases, a size of a paper storing portion of the refeed tray is variable to be adapted to a size of paper stored. This is because there are various sizes of paper, e.g., B4, A4 or B5-size paper, fed from paper feed portions such as paper feed cassettes although generally only one refeed tray is provided, and it is necessary to adapt the refeed tray for such various sizes of paper.

The paper size which is necessary data for determining the size of the paper storing portion of the refeed tray is detected conventionally in a paper feed cassette which stores paper to be fed.

For example, if an A4 paper feed cassette is selected as a feed opening to feed paper of the A4 size, a code signal indicating the A4 size is inputted to a control CPU of the copying apparatus. The CPU evaluates the paper size based on the code signal and a predetermined table so as to change the size of the paper storing portion of the refeed tray. Thus, detection of the paper size is effected in the paper feed cassette. For this reason, for example in manual feed copy, in which paper is manually fed from outside as required without using a paper feed cassette, the paper size cannot be detected because the paper does not pass through the paper feed cassette. Accordingly, the size of the paper storing portion of the refeed tray cannot be determined and neither duplex copy nor composite copy can be executed.

In addition, the precision of detection of paper size in the paper feed cassette is not so high. This is because the main object of paper size detection is to indicate selection of paper of any size such as A4 or B5 and not to detect an actual size of individual paper. Therefore, the detection method adopted is the method of inputting a code signal corresponding to a selected paper feed cassette. However, for example in the case of "paper of the A4 size", the size is not always the same in a strict sense and there is sometimes a little error. In addition, it happens that paper of a size different from the A4 size is stored in an A4 paper storing cassette. In such a case, a trouble such as paper jam in the refeed tray is likely to occur because the size of paper actually stored is different from the size based on the data for determining the size of the paper storing portion of the refeed tray.

SUMMARY OF THE INVENTION

An object of the present invention is to provide an image forming apparatus in which paper jam never occurs in a paper refeed tray.

Another object of the present is to provide an image forming apparatus in which a size of a storing portion of a paper refeed tray can be made to precisely coincide with a paper size.

Another object of the present invention is to provide an image forming apparatus in which a paper size detection mechanism is not required in a paper feed cassette.

A further object of the present invention is to provide an image forming apparatus capable of performing duplex copy and composite copy even in the case of manual feed of paper.

A still further object of the present invention is to provide an image forming apparatus in which paper size detection for a paper refeed tray is not required for the second and subsequent sheets of paper in a multicopy mode.

A further object of the present invention is to provide an image forming apparatus capable of suitably controlling a time required for feeding a first sheet of paper and that for feeding a second sheet of paper in a multicopy mode.

A still further object of the present invention is to provide an image forming apparatus in which paper jam never occurs in a paper refeed tray at the time of continuously performing duplex or composite copy by using manually fed paper.

In order to accomplish the above described objects, an image forming apparatus according to the present invention comprises an image forming apparatus in which paper having one surface where an image has been formed by an image forming portion is transported to and stored in a paper refeed tray and it is refed to the image forming portion by means of the paper refeed tray so that an image is formed on either side of the paper, and this image forming apparatus comprises regulation means, drive means, detection means and control means. The regulation means has regulation members which regulate edges of paper stored in the paper refeed tray and are movable in a direction toward the stored paper and a direction departing therefrom. The drive means moves the regulation members in the opposite two directions. The detection means is provided in each regulation member and generates a detection signal when the regulation member contacts an edge of paper stored in the paper refeed tray. The control means moves the regulation members away from the paper when the paper is stored in the paper refeed tray, and the control means moves the regulation members toward the paper after the paper has been stored and stops the regulation members in response to the signal from the detection means.

The image forming apparatus thus constructed detects a paper size directly from the stored paper and accordingly paper jam never occurs in the paper refeed tray and the size of the storing portion of the paper refeed tray can be made to accurately coincide with the paper size.

In order to accomplish the above described objects, an image forming apparatus according to an aspect of the present invention comprises an image forming apparatus which continuously executes image forming operation for a designated number of sheets in a paper refeed mode in which paper having a first image formed by an image forming portion is stored in a paper refeed tray and refed to the image forming portion to form a second image on the paper, thus forming the first image on a plurality of sheets and subsequently forming the second image on the plurality of sheets, and this image forming apparatus comprises regulation means, drive means, detection means and control means. The regulation means has regulation members which regulate edges of paper stored in the paper refeed tray and are movable in opposite two directions, i.e., toward and away from the stored paper. The drive means moves the regulation members in the opposite two directions. The detection means detects a contact between each regulation member and an edge of paper stored in the paper refeed tray, and generates a signal. The control means moves the regulation members away from the paper refeed tray at the time of storing a first sheet of paper in the paper refeed tray, and after the first sheet of paper has been stored, the control means moves the regulation members toward the paper and stops the regulation members in response to the signal from the detection means. Further, at the time of storing the second and subsequent sheets of paper in the paper refeed tray, the control means controls movement of the regulation members based on the positions thereof for the first sheet of paper.

The image forming apparatus thus constructed controls the regulation members for the second and subsequent sheets of paper based on the positions of the regulation members for the first sheet of paper in the multicopy mode. Consequently, detection of the size of the second and subsequent sheets of paper is not required.

In order to accomplish the above described objects, an image forming apparatus according to another aspect of the present invention comprises an image forming apparatus which consecutively executes image forming operation for a designated number of sheets of paper in a paper refeed mode in which paper having a first image formed by an image forming portion is stored in a paper refeed tray and is refed to the image forming portion for formation of a second image on the paper, thus forming the first image on the plural number of sheets and then forming the second image on the plural number of sheets, and this image forming apparatus comprises size detection means, paper regulation members, drive control means and forbidding control means. The size detection means detects a size of paper stored in a paper refeed tray directly from the paper. The paper regulation members locate, in a predetermined position in the paper refeed tray, the paper to be stored in the tray. The drive control means moves the paper regulation members to set the paper in the predetermined position according to the paper size detected by the detection means at the time of storing the first sheet of paper in the paper refeed tray and sets the second and subsequent sheets of paper based on the position of the first sheet of paper set in the predetermined position at the time of storing the second and subsequent sheets of paper in the paper refeed tray. The forbidding control means forbids storing of the second sheet of paper in the paper refeed tray until completion of preparation for locating the first sheet of paper in the predetermined position.

The image forming apparatus thus constructed forbids storing of the second sheet of paper in the paper refeed tray until completion of preparation for positioning by the paper regulation members with respect to the first sheet of paper and accordingly the image forming apparatus can control appropriately the time required for feeding the first sheet of paper and that for feeding the second sheet of paper in the multicopy mode.

In order to accomplish the above described objects, an image forming apparatus according to a further aspect of the present invention comprises an image forming apparatus which consecutively executes image forming operation for a designated number of sheets of paper in a paper refeed mode in which paper having a first image formed by an image forming portion is stored in a paper refeed tray and then it is refed to the image forming portion for formation of a second image on the paper, thus forming the first image on the plural number of sheets of paper and subsequently forming the second image on the plural number of sheets of paper, and this image forming apparatus comprises size detection means, paper regulation members, drive control means, manual feed means and forbidding control means. The size detection means detects a size of paper stored in the paper refeed tray directly from the paper. The paper regulation members locate, in a predetermined position in the paper refeed tray, paper to be stored in the paper refeed tray. The drive control means controls movement of the paper regulation members to set paper in the predetermined position according to a paper size detected by the size detection means. The manual feed means manually feeds paper to the image forming portion for forming the first image. The forbidding control means forbids subsequent feeding of paper by the manual feed means until the second image has been formed on paper fed, if feeding of paper by the manual feed means is consecutively performed in a paper refeed mode.

In the image forming apparatus thus constructed, subsequent feeding of paper is not permitted until the second image has been formed on previously fed paper when the manual feed means consecutively feeds paper. Consequently, even if the duplex or composite copy is performed by manual feed of paper, paper jam never occurs in the paper refeed tray.

The foregoing and other objects, features, aspects and advantages of the present invention will become more apparent from the following detailed description of the present invention when taken in conjunction with the accompanying drawings.

DESCRIPTION OF THE PREFERRED EMBODIMENT

Description of General Construction

Figure 1:
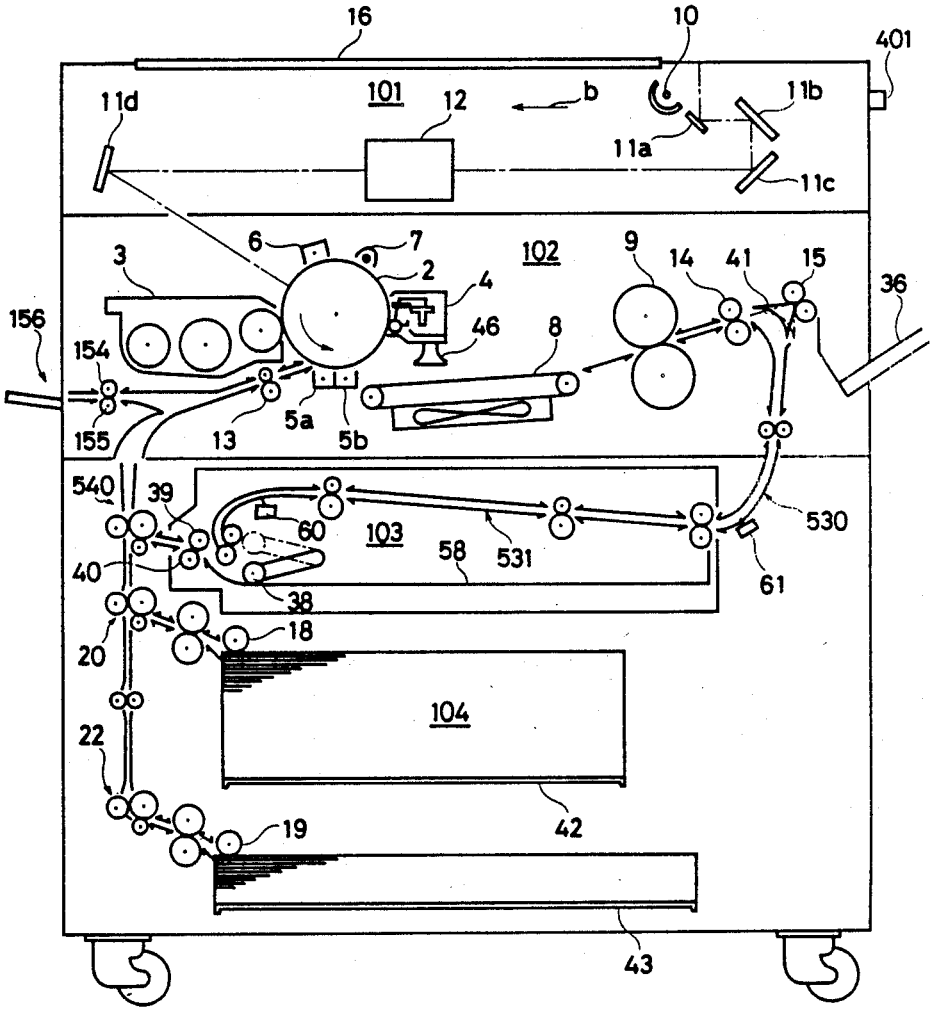
FIG. 1 is a schematic structural view of a copying apparatus according to an embodiment of the present invention.

FIG. 1 illustrates a structure of a copying apparatus according to an embodiment of the present invention.

This copying apparatus comprises an optical system 101 in an upper portion, an image forming portion 102 in an intermediate portion, a paper refeed unit 103 in a lower portion, and a paper feed unit 104 under the unit 103. There are further provided a manual feed portion 156 on the left of the figure and a power switch 401 for turn-on of power supply on a right side face of a main body of the copying apparatus.

Optical System 101

The optical System 101 scans an original placed on an original glass plate 16 by applying light thereto and projects an image of light reflected from the original onto a surface of a photoreceptor drum 2 of the image forming portion 102.

The optical system 101 comprises an exposure lamp 10, reflection mirrors 11*a*, 11*b*, 11*c* and 11*d*, and a lens 12. The exposure lamp 10 and the reflection mirror 11*a* move in a reciprocating manner at a speed V/N (V being a rotating speed of the photoreceptor drum 1 and N being a copying magnification) under the original glass plate 16 and the reflection mirrors ll*b* and ll*c* move in a reciprocating manner at a speed V/2N under the plate 16, whereby the original is scanned. The copying magnification is set by adjustment of the position of the lens 12 and the position of image formation on the drum 2 is corrected by adjustment of an angle of the reflection mirror 11*d* .

Image Forming Portion 102

The image forming portion 102 executes image formation by the so-called electrophotographic process. In other words, an electrostatic latent image formed on the photoreceptor drum 2 is developed by toner and the toner image is transferred onto copy paper and fixed, so that the paper is discharged.

The image forming portion 102 comprises the photoreceptor drum 2 supported rotatably in the counterclockwise direction, an eraser lamp 7, a corona charger 6, a developing device 3, a transfer charger 5*a*, a separation charger 5*b* and a cleaning device 4 which are provided around the photoreceptor drum 2, a transport belt 8 for transporting copy paper on which an image is transferred, and a fixing device 9 for fixing the toner image on the paper transported. There is provided, under the developing device 3, a timing roller pair 13 which sends copy paper fed thereto to a portion between the photoreceptor drum 2 and the transfer charger 5*a* with predetermined timing in synchronization with rotation of the photoreceptor drum 2. Roller pairs 14 and 15 which discharge copy paper having a fixed image from the image forming portion 102 are provided on the right of the fixing device 9 in the figure.

Selection as to whether the copy paper from the image forming portion 102 is to be discharged onto a discharge tray 36 or into a refeed tray 58 to be described later is effected by means of a selection lever 41 operated by a solenoid, not shown.

Paper Refeed Unit 103

The paper refeed unit 103 is used in composite copy and duplex copy.

Copy paper having one surface on which a copy image is fixed is temporarily stored in the paper refeed tray 58 through a path 530 in the case of composite copy or through paths 530 and 531 in the case of duplex copy. More specifically, the copy paper is stored in the tray 58 with the surface containing the image being directed downward in the case of composite copy or directed upward in the case of duplex copy. After that, the paper is delivered by a refeed roller 38, passes through roller pairs 39 and 40 and a feed path 540 and it attains the timing roller pair 13, so that a copy process is executed again.

The paper refeed unit 103 will be described in more detail afterwards.

Paper Feed Unit 104

The paper feed unit 104 has an upper feed tray 42 and a lower feed tray 43 for containing sheets of paper of different sizes. Paper in each tray is delivered by means of a feed roller 18 or 19 and fed to the timing roller pair 13 of the image forming portion 102 by means of an automatic feed mechanism 20 or 22. Then, it is sent between the photoreceptor drum 2 and the transfer charger 5*a* in synchronization with rotation of the photoreceptor drum 2 in response to a predetermined timing signal from the optical system 101, so that the above described image forming process is applied thereto.

Manual Feed Portion 156

The manual feed portion 156 is provided on the left side portion of the main body of the copying apparatus. Paper manually set in this feed portion is transported through feed rollers 154 and 155 to the timing roller pair 13, so that the image forming process is applied to the paper.

Description of Paper Refeed Unit

Figure 2:
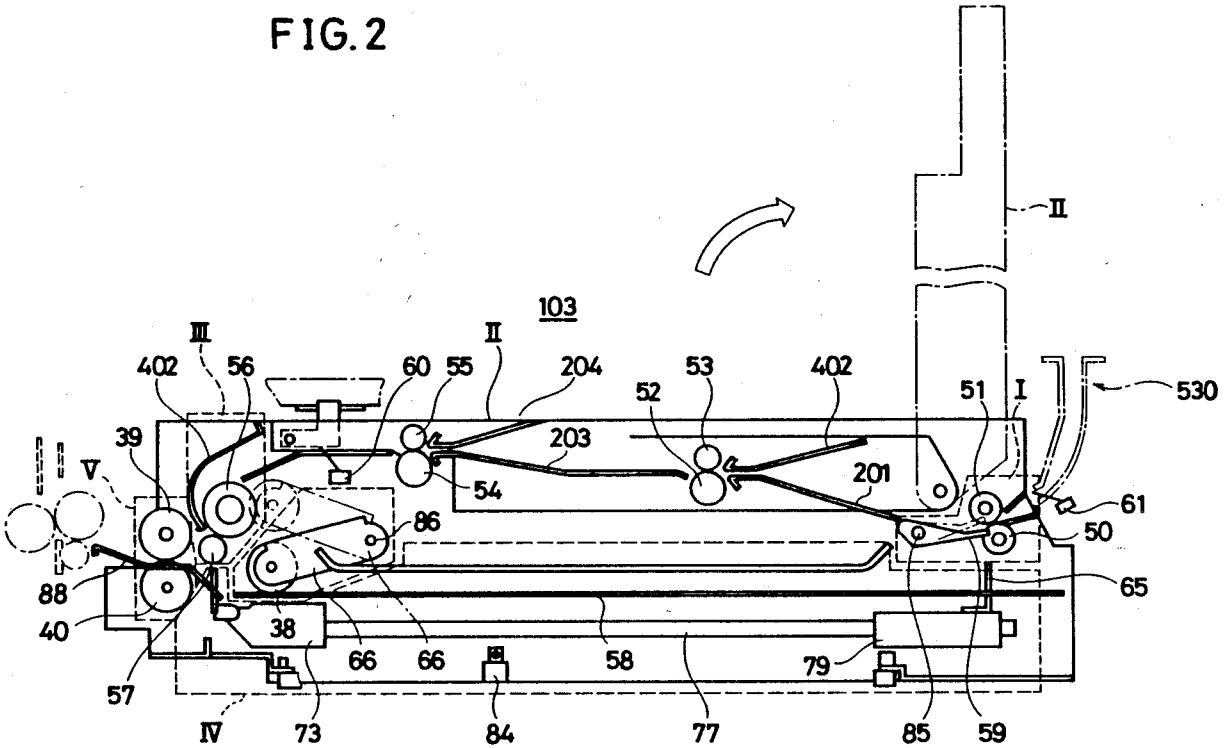
FIG. 2 is a schematic structural view of a paper refeed unit shown in FIG. 1.
Figure 3:
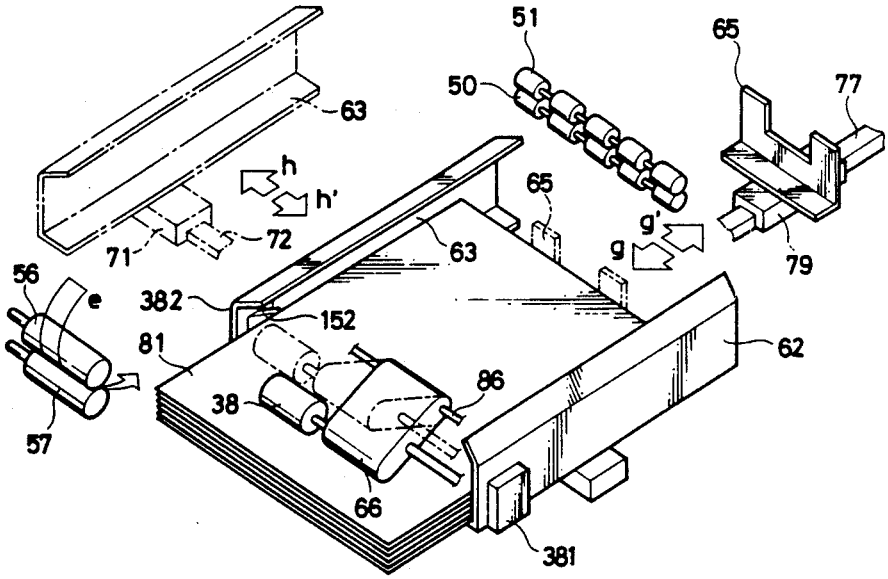
FIG. 3 is a perspective exploded view of the paper refeed tray shown in FIG. 2.
Figure 4:
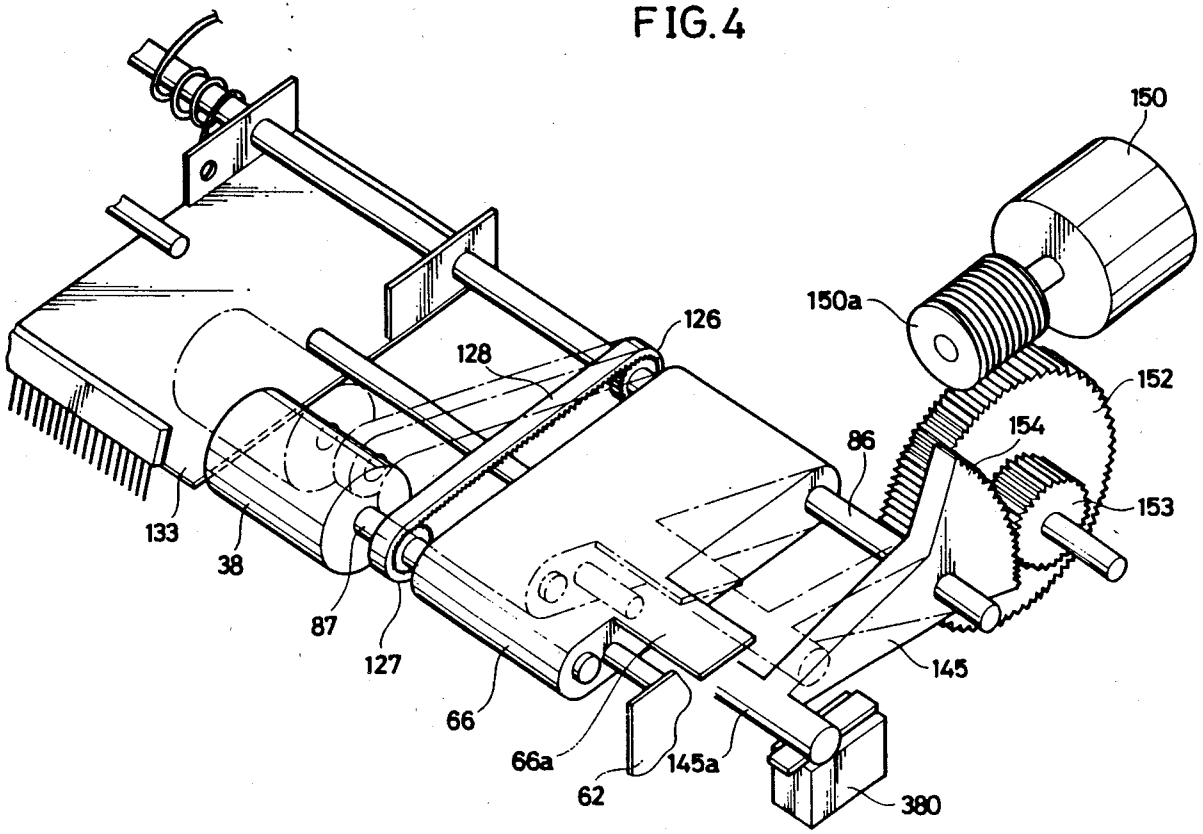
FIG. 4 is a perspective view showing a structure of a paper refeed roller portion shown in FIG. 3.
Figure 5:
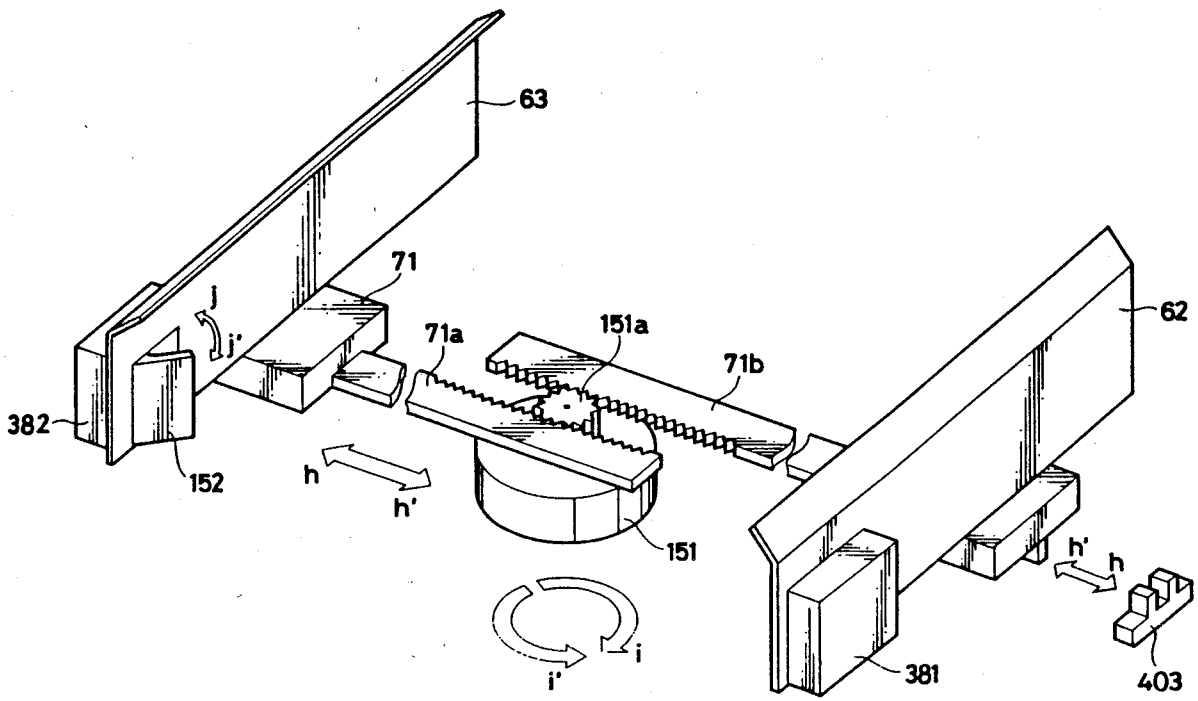
FIG. 5 is a perspective view of a drive mechanism of side regulator plates shown in FIG. 3.

FIG. 2 is a view showing an internal structure of the paper refeed unit 103 provided in the above described copying apparatus and FIG. 3 is a perspective exploded view of this paper refeed unit 103. FIG. 4 is an enlarged view of the paper refeed roller portion 38 and FIG. 5 is an illustration for explaining a drive mechanism of side regulator plates 62 and 63.

(i) General Outline of Mechanism

The paper refeed unit 103 shown in FIG. 2 has a switching block I, a transport block II, a reversing block III, a registration tray block IV and a refeed block V which are formed integrally as a unit.

The switching block I switches between the copy paper transport paths in the duplex copy mode and the composite copy mode. This block I has transport rollers 50 and 51, and a selection lever 59 rotatable about an axis 85. The switching block I may be provided in the main body of the copying apparatus.

The transport block II has a transport path 531 (shown in FIG. 1) for copy paper in the duplex copy mode. This transport block II has transport roller pairs 52–53 and 54–55, and guide plates 201, 202, 203 and 204.

The reversing block III has reverse transport rollers 56 and 57, and a reversing guide 42. This block II reverses copy paper transported through the transport block II and sends it to the paper refeed tray 58.

The registration tray block IV has the paper refeed tray 58, a slide rail 77, slide members 73 and 79, regulator plates 62, 63 and 65 (as shown in FIG. 3). This block IV registers sheets of copy paper sent to the paper refeed tray 58.

The paper refeed block V has a holder 66, the refeed roller 38, delivery rollers 39 and 40, and a guide plate 88. This block V refeeds, one by one, the sheets of copy paper registered on the refeed tray 58.

(ii) Operation in Duplex/Composite Copy

In the duplex copy mode, the selection lever 59 is set at a position shown by the solid lines in FIG. 2.

Copy paper is guided on the upper surface of the lever 59 and sent to the transport block II, whereby it is transported leftward in the figure by means of the transport rollers 52, 53, 54 and 55 while it is guided by the guide plates 201, 202, 203 and 204. Then, the paper is reversed by the reverse transport rollers 56 and 57 and the reversing guide 93, so that it is sent to the paper refeed tray 58 with the surface containing a copy image being directed upward. The sheets of copy paper thus sent are registered on the tray 58 so as to be refed one by one to the image forming portion by the clockwise rotation of the refeed roller 38.

In the composite copy mode, the selection lever 59 is set at the position shown by the chained lines in FIG. 2.

In this mode, copy paper is guided on the lower surface of the lever 59 and sent directly to the paper refeed tray 58 with the surface containing a copy image being directed downward, without passing through the transport block II. Then, the sheets of copy paper thus sent are registered on the paper refeed tray 58 and refed one by one to the image forming portion 102 by the clockwise rotation of the refeed roller 38 in the same manner as in the duplex copy mode.

(iii) Mechanism and Operation of the Refeed Roller (see FIG. 4)

The refeed roller 38 is movably supported by a support shaft 86 of the holder 66 and it is set to three positions. More specifically, when copy paper is sent onto the paper refeed tray 58, the roller 38 is set to the upper or intermediate position, while it is set to the low position and presses on the copy paper with a suitable pressure when the copy paper is to be refed (delivered).

The above described positioning of the paper refeed roller 38 is effected in the below described manner.

A lever 145 is rotatably supported at one end of the support shaft 86 of the holder 66 and a holder extension portion **66*a* extending from a top end of the holder 66 is placed on a front edge portion (a left lower portion in the figure) 145*a* of the lever 145. Accordingly, when the lever 145 rotates clockwise, the holder 66 supported through the extension portion 66*a* on the front edge portion 145*a* of the lever moves upward in the figure. The turning force for the lever 145 is given by a stepping motor 150 having an output shaft coupled to a worm 150*a* through a sector gear 154 formed in the rear edge portion (the right upper portion in the figure) of the lever 145, a spur gear 153 engaged with the sector gear 154, a worm wheel 152 rotating together with the spur gear 153, and the worm 150*a* engaged with the worm wheel 152**.

Refeeding (delivery) of stored copy paper is effected in the below described manner.

The refeed roller 38 is rotatably supported by a top end of the holder 66 through a roller shaft 87 rotating together with the roller 38. The roller shaft 87 is connected to the above mentioned support shaft 86 through pulleys 126 and 127 and a timing belt 128. The support shaft 86 is connected to an output shaft of a main motor, not shown, through a refeed clutch. Consequently, when the support shaft 86 is driven to be rotated by turn-on of the refeed clutch, the driving force is transmitted to the refeed roller 38 through the pulleys 126 and 127 and the timing belt 128. As a result, the refeed roller 38 rotates in the clockwise direction and the copy paper is delivered from the tray 58 by the rotation. At this time, a support member 133 having one end provided with a charge removal brush and supported rotatably by the support shaft 86 moves together with the refeed roller 38. Charge on the copy paper delivered is removed by the charge removal brush.

The refed paper passes through the rollers 39 and 40 and is guided by the guide plate 88 to attain the image forming portion 102, where an image is formed on the paper.

(iv) Registration of Copy Paper (see FIGS. 3 and 5)

Registration of copy paper sheets in the refeed tray 58 is effected by movement of the side regulator plates 62 and 63 and the back regulator plate 65.

The back regulator plate 65 is provided together with a slide member 79 slidable on a guide rail 77 extending in the paper feeding direction as shown in FIG. 3. The slide member 79 is driven by the stepping motor (not shown) so as to slide on the guide rail 77 in the direction of the arrow g or g'.

On the other hand, the side regulator plates 62 and 63 are provided together with a slide member 71 slidable on a guide rail 72 extending in the direction perpendicular to the paper feeding direction. The slide member 71 is driven by a motor 151 (as shown in FIG. 5) so as to slide on the guide rail 72 in the direction of the arrow h or h'.

For example, when the motor 151 rotates in the direction of the arrow i as shown in FIG. 5, a rack **71*a* engaged with the spur gear 151*a* coupled to the output shaft of the motor 151 moves in the direction of the arrow h. As a result, the slide member 71 formed integrally with the rack 71*a* also moves in the direction of the arrow h. It is the same with the rack 71*b*. As a result, a distance between the regulator plates 62 and 63 is increased. In the following, positions where the distance between the regulator plates 62 and 63 is the largest are called home positions. A sensor 403 is provided for detection as to whether the regulator plates 62 and 63 are in the home positions. In other words, turn-on of the sensor 403 means that the regulator plates 62 and 63** are in the respective home positions.

On the other hand, movement of the regulator plates in the direction h' in which the distance therebetween is decreased corresponds to the rotating direction i' of the motor.

In FIG. 3, the arrow e indicates a direction in which copy paper is sent to the paper refeed tray 58 in the duplex copy mode.

In the above described operation, timing for stopping or other adjustment of the moving side regulator plates is applied in the following manner.

As shown in FIGS. 3 and 5, top ends (left lower portions in the figure) of the side regulator plates 62 and 63 have contact detection sensors 381 and 382, respectively, for detecting contact with paper in the tray.

Figure 7:
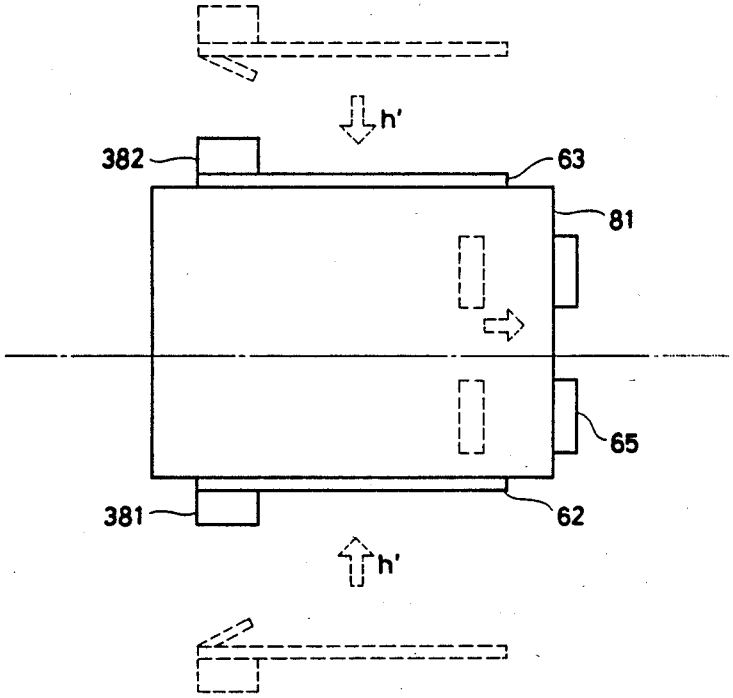
FIG. 7 is an illustration for explaining a positional relation between the side regulator plates of FIG. 5 and paper, showing a state in which the two regulator plates are in contact with the paper.
Figure 8:
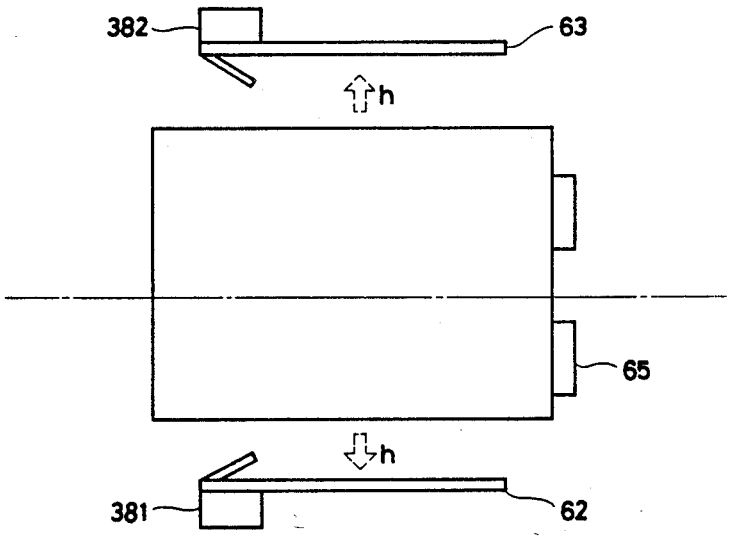
FIG. 8 is an illustration for explaining a positional relation between the side regulator plates of FIG. 5 and paper, showing a state in which the regulator plates are set apart in preparation for storing the second or subsequent sheet of paper.

For example, when the side regulator plates 62 and 63 move in the direction decreasing the distance therebetween to cause the paper in the tray to press movable plates (provided on the respective inner walls of the regulator plates, movable in the directions j and j' in the figure and energized in the direction j'), the pressing force moves the movable plates 152 in the direction j, which movement is detected by the sensors 381 and 382. Based on detection signals from the sensors, paper in the refeed tray is positioned in the central position as shown in FIGS. 6 to 8.

More specifically, when the paper 81 is stored in the tray, the regulator plates 62 and 63 start to move from the home positions (shown by the dotted lines in FIG. 6) in the direction h'.

Figure 6:
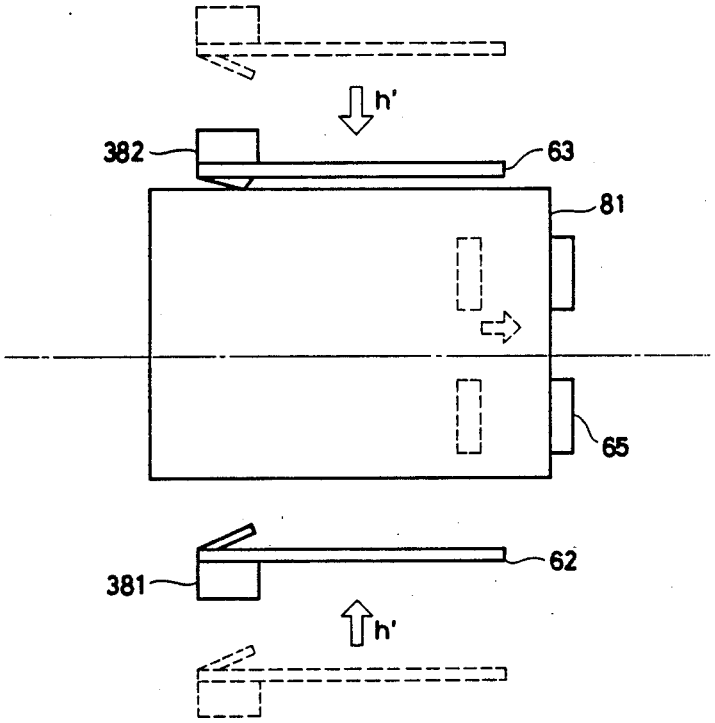
FIG. 6 is an illustration for explaining a positional relation between the side regulator plates of FIG. 5 and paper, showing a state in which one regulator plate is in contact with the paper.

After the start of the movement, if the paper is not in the central position, one of the regulator plates (the regulator plate 63 in the figure) is first brought into contact with the paper 81 (as shown in FIG. 6). However, in this state, the movement of the regulator plates continues. After that, when both of the regulator plates are in contact with the paper 81 (as shown in FIG. 7), the movement of the regulator plates is stopped. Thus, at this moment, the paper 81 is set at the central position.

Before the second or subsequent sheet is stored in the tray, the two regulator plates are moved in the direction h to be separated from the tray by a predetermined distance (5 mm in this embodiment), which allows sufficient margins for storing of the subsequent sheets of paper.

Description of Operation Panel

Figure 9:
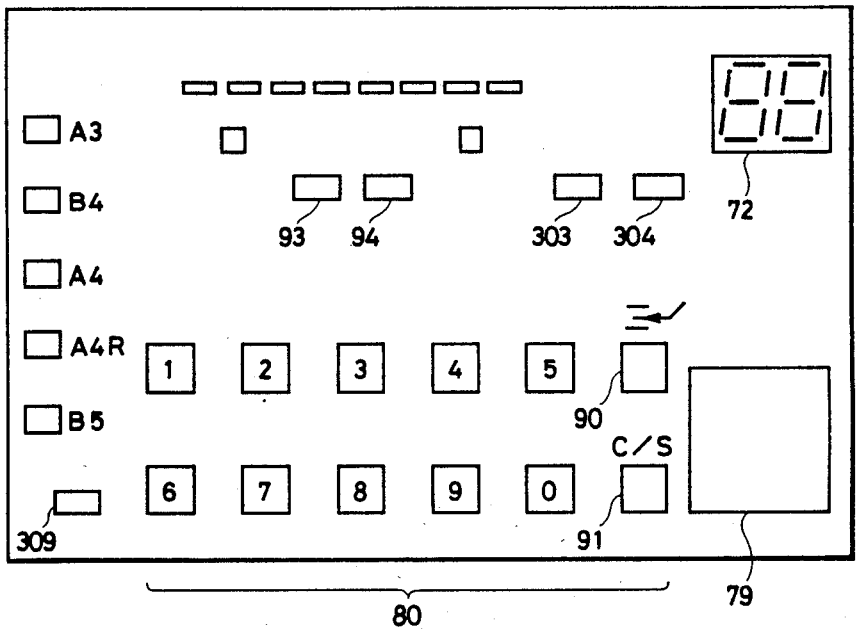
FIG. 9 is a plan view of an operation panel of the copying apparatus according to the above mentioned embodiment.

FIG. 9 is an illustration showing an operation panel of the above described copying apparatus.

As shown, the operation panel comprises a ten-key group 80 for entering the number of copies or the like, a print key 79 for instructing a start of printing, an interruption key for instructing an interruption copy, a clear/stop key 91, a paper selection key 309 for selection between copy paper of the upper feed tray 42 and that of the lower feed tray 43, density up/down keys 93 and 94 for setting a copy density, a segment display 72 for displaying the number of copies or the like, a duplex mode selection key 303 for selecting the duplex copy mode, a composite mode selection key 304 for selecting the composite copy mode, etc.

Description of Control Circuit

Figure 10:
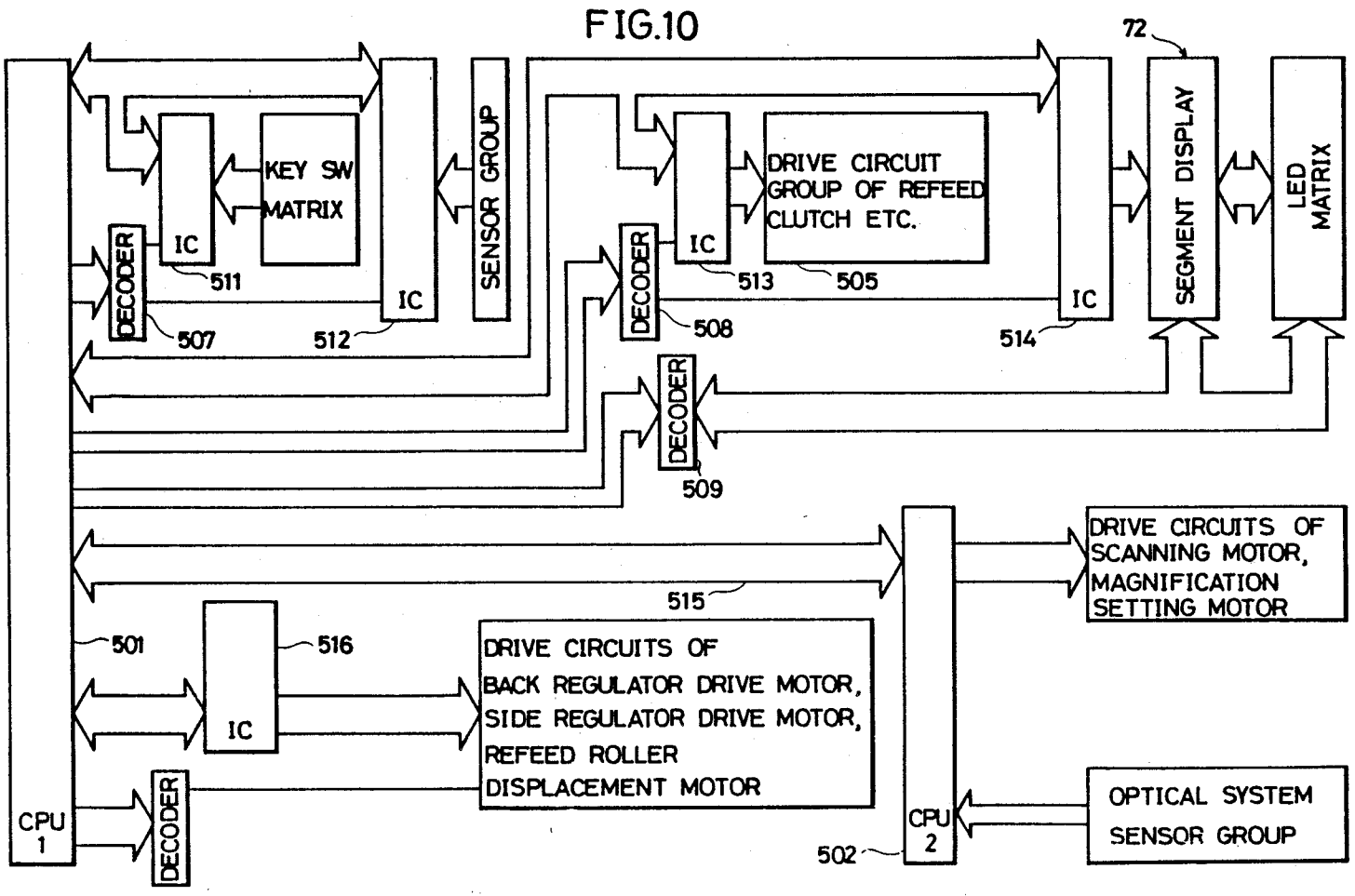
FIG. 10 is a diagram showing configuration of a control circuit of the copying apparatus according to the embodiment.

FIG. 10 is a diagram showing a circuit for controlling operation of the copying apparatus. The control circuit comprises a first CPU 501 for controlling the image forming portion 102 and the paper feed units 103 and 104, and a second CPU 502 for controlling the optical system 101.

Signals from various keys on the operation panel and sensors provided in the main body of the apparatus for detecting operation conditions thereof etc. are inputted to the first CPU 501 through input extension ICs 511 and 512.

On the other hand, the first CPU 501 outputs control signals for a drive circuit group 505 for driving the main motor, a developing motor, various clutches, solenoids and the like, through an output extension IC 513 and outputs control signals for the segment display portion 72 and the LED displays on the operation panel, through an output extension IC 514.

Further, the first CPU 501 outputs, through an output extension IC 516, control signals for controlling a back regulator plate drive motor 154, the side regulator plate drive motor 151 and the refeed roller movement motor 150.

The first CPU 501 is connected to the second CPU 502 through a bus 515 to communicate data therewith.

The second CPU 502 receives signals from the sensors provided in the optical system 101 for detecting scanning conditions and the like, and outputs control signals to drive circuits for a scanning motor and a magnification setting motor.

DESCRIPTION OF CONTROL OPERATION

A. General Procedures

Figure 11:
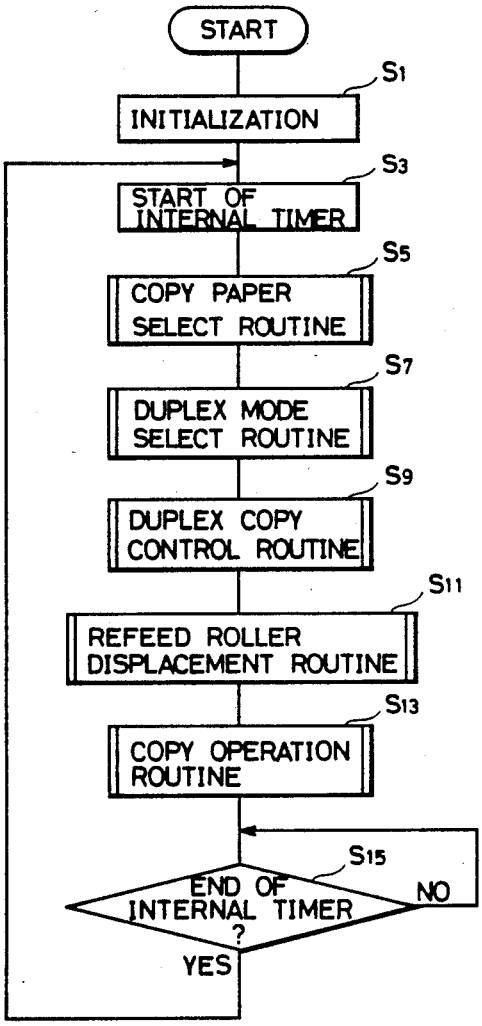
FIG. 11 is a flow chart showing processing procedures of a first CPU 201 shown in FIG. 10.

FIG. 11 is a flow chart showing general procedures of the first CPU 501.

First, initialization is effected in the step S1 and then an internal timer for defining a period of one routine is set (in the step S3).

Subsequently, after the steps S5 to S13 are executed, the CPU 501 waits for an end of the internal timer set in the step S3 and then the processing flow returns to the step S3.

S5: Copy Paper Selection

In this step, the feed trays are successively selected in response to input through the paper size select key 309.

S7: Duplex Mode Selection

In this step, switching between setting and canceling of the duplex copy mode is made in response to input through the duplex mode selection key 303.

S9: Duplex Copy Control

This step relates to procedures for controlling movement or the like of the regulator plates for determining a size of a paper storing portion in the refeed tray 58 in the duplex copy mode.

Details of these procedures will be described afterwards.

S11: Displacement of Refeed Roller

This step relates to procedures such as control of the position of the refeed roller 38 at the time of refeeding paper from the refeed tray 58 in the duplex copy mode.

S13: Copy Operation

In this step, copy operation is controlled.

B. Subroutines

Figure 12:
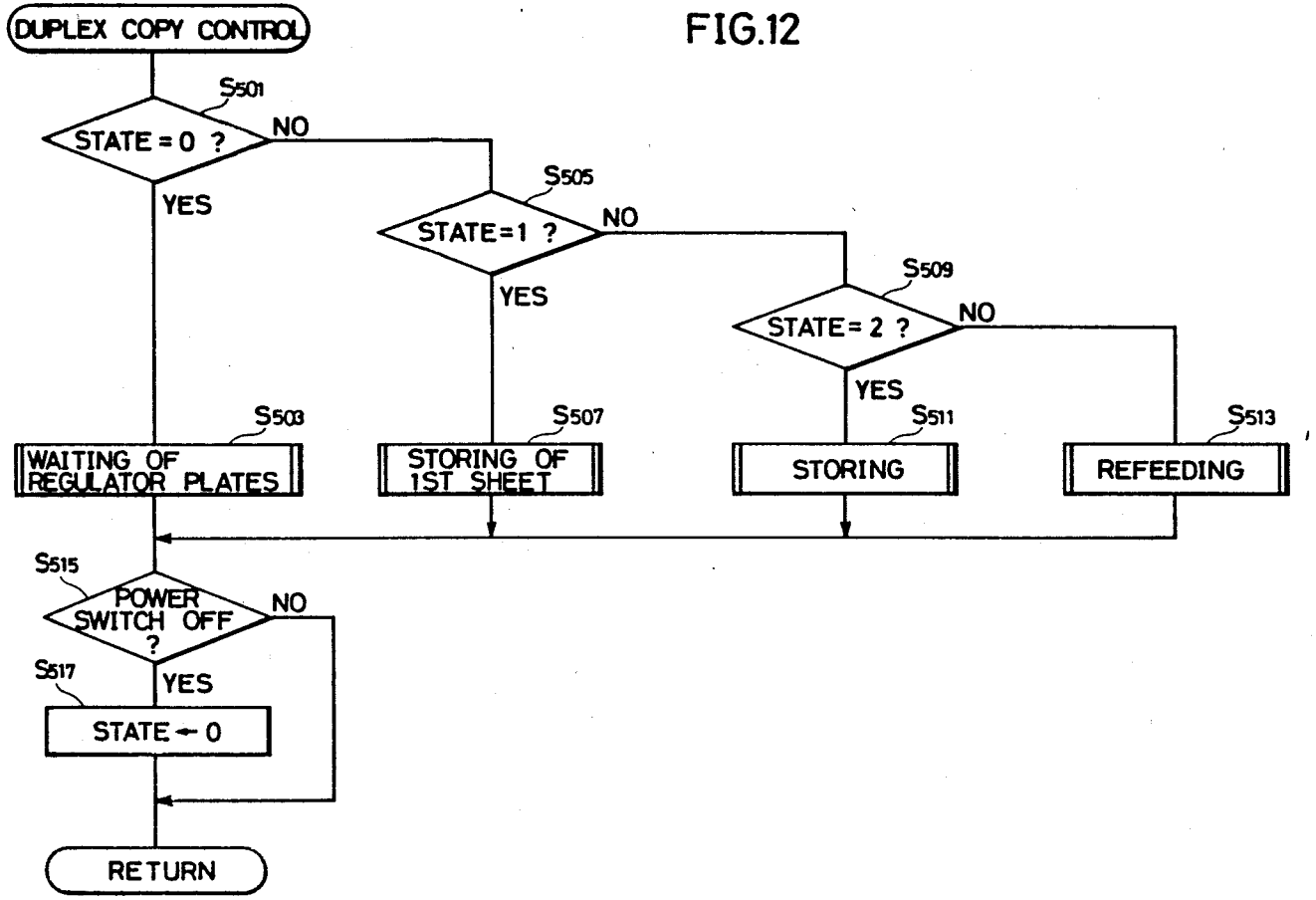
FIG. 12 is a flow chart showing concrete procedures for control of duplex copy in FIG. 11.

FIG. 12 is a flow chart showing detailed procedures of the step S9 (for duplex copy control).

First, a content of a state counter is determined.

Then, according to the value of the state counter, any of a regulator plate wait routine (STATE =0), a first sheet storing routine (STATE =1), a storing routine (STATE =2) and a refeed routine (STATE =3) is called.

If the power switch 401 is turned off (in the case of YES in the step S515), the count value of the state counter is reset to 0 (in the step S517). Thus, end operation such as returning of the regulator plates to the home positions is controlled. The home positions for the side regulator plates 62 and 63 are he positions (as shown by the dotted lines in FIGS. 6 and 7) in which the distance therebetween is the largest as described previously. The home position for the back regulator plate 65 is a position enabling the tray to store copy paper of the B5 size with its shorter sides parallel to the feed direction, which corresponds to the smallest copy area size of the copying apparatus. More specifically, it is a position of the back regulator plate 65 spaced from the leading edge of the refeed tray (the left edge in the figure) by a distance corresponding to the shorter side (182 mm) of the B5 size. A sensor 84 shown in FIG. 2 is used for detection as to whether the back regulator plate 65 is in the home position or not. In other words, turn-on of the sensor 84 means that the back regulator plate 65 is in the home position.

Figure 13A:
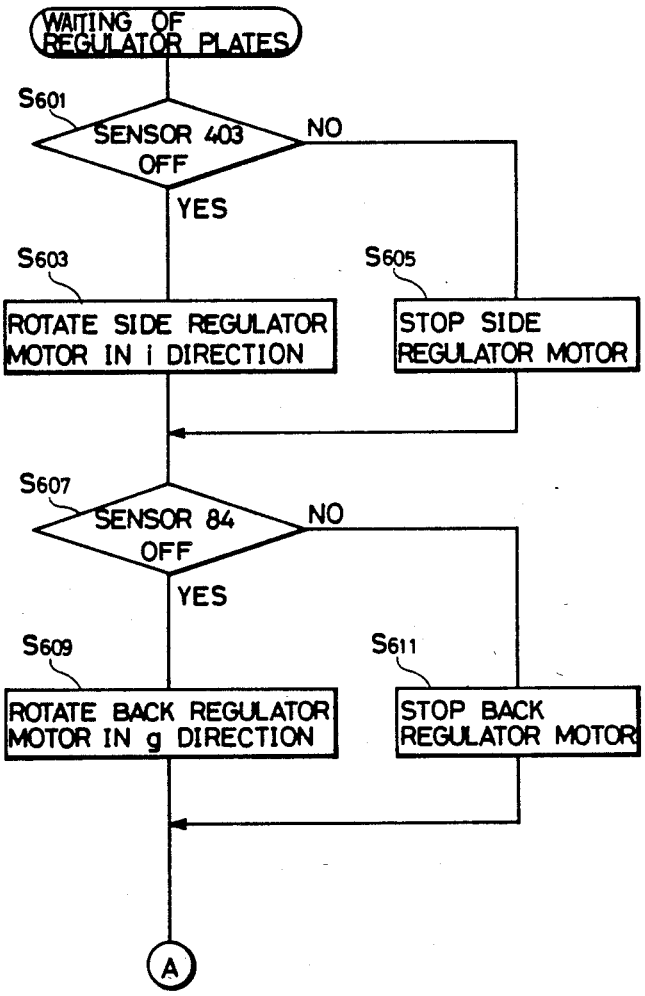
FIGS. 13A and 13B are flow charts showing concrete procedures for waiting of the regulator plates shown in FIG. 12.
Figure 13B:
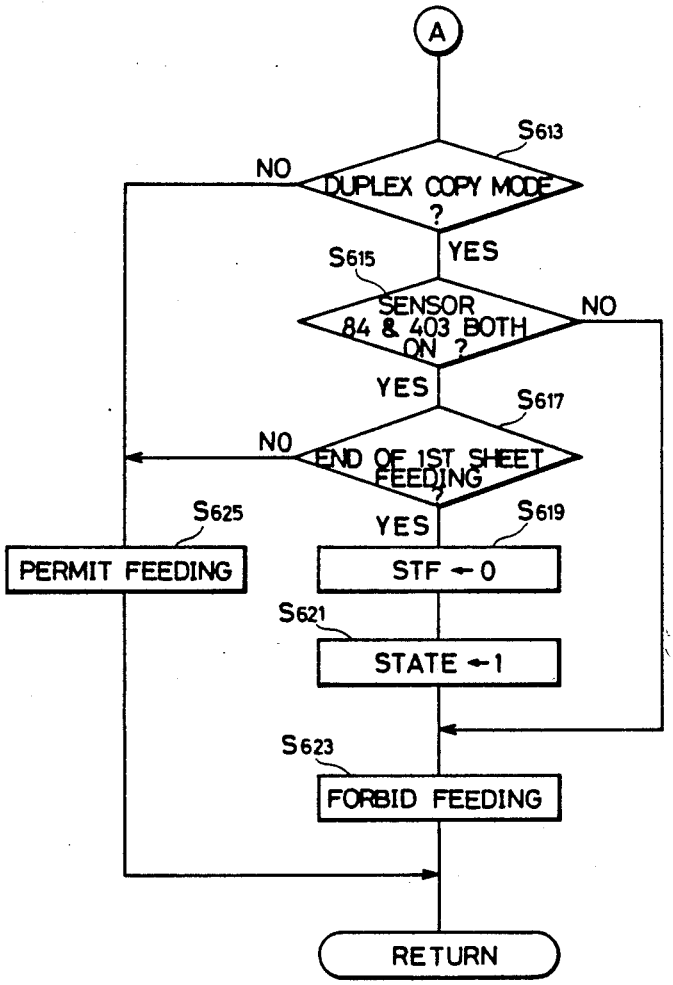

FIGS. 13A and 13B are flow charts showing the regulator plate wait routine (in S503 in FIG. 12).

The steps S601 to S611 relate to control for setting the respective regulator plates in the home positions.

More specifically, if the sensor 403 (for detecting existence of the side regulator plates in the home positions as shown in FIG. 5) is maintained in the off state, which means that the side regulator plates 62 and 63 are not in the home positions, the side regulator plate drive motor 151 is rotated in the direction i (as shown in FIG. 5) and the regulator plates 62 and 63 are driven to move in the direction increasing the distance therebetween (the direction h as shown in FIG. 5) (in S601 to S605).

If the sensor 84 (for detecting the back regulator plate in the home position as shown in FIG. 2) is maintained in the off state, which means that the back regulator plate 65 is not in the home position, a back regulator plate drive motor not shown is rotated to move the back regulator plate 65 in the direction g (as shown in FIG. 3) (in S607 to S611).

The steps S613 to S625 are steps for controlling permission and forbidding of paper feeding, change of the count value of the state counter and the like.

More specifically, in the duplex copy mode (in the case of YES in S613), if the respective regulator plates are in the home positions (in the case of YES in S615) and if the first sheet of paper has not been fed yet (in the case of NO in S617), feeding of the first sheet of paper is permitted (in S625).

On the other hand, if it is determined in S617 that the first sheet of paper has been fed, an STF flag which serves to control operation in the first sheet storing routine is set to 0 (in S619). Then, the state counter is set to 1 (in S621) and feeding of the next sheet is forbidden (in S623).

Figure 14A:
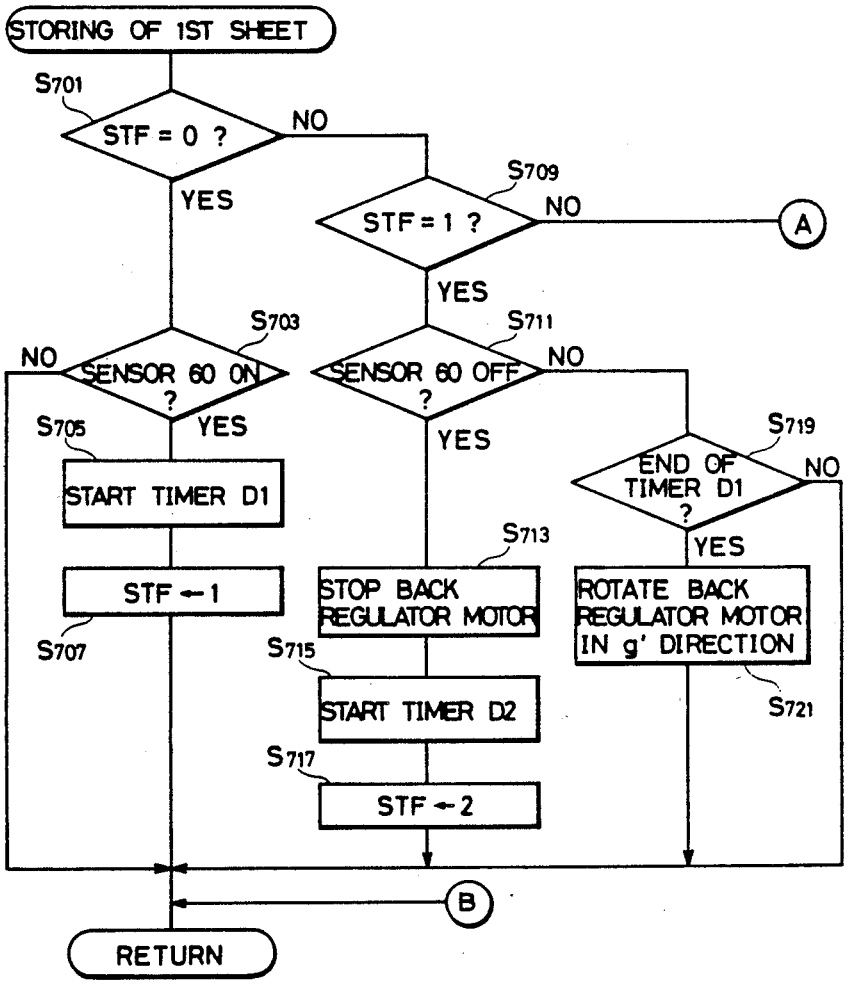
FIGS. 14A and 14B are flow charts showing concrete procedures for storing of the first sheet shown in FIG. 12.
Figure 14B:
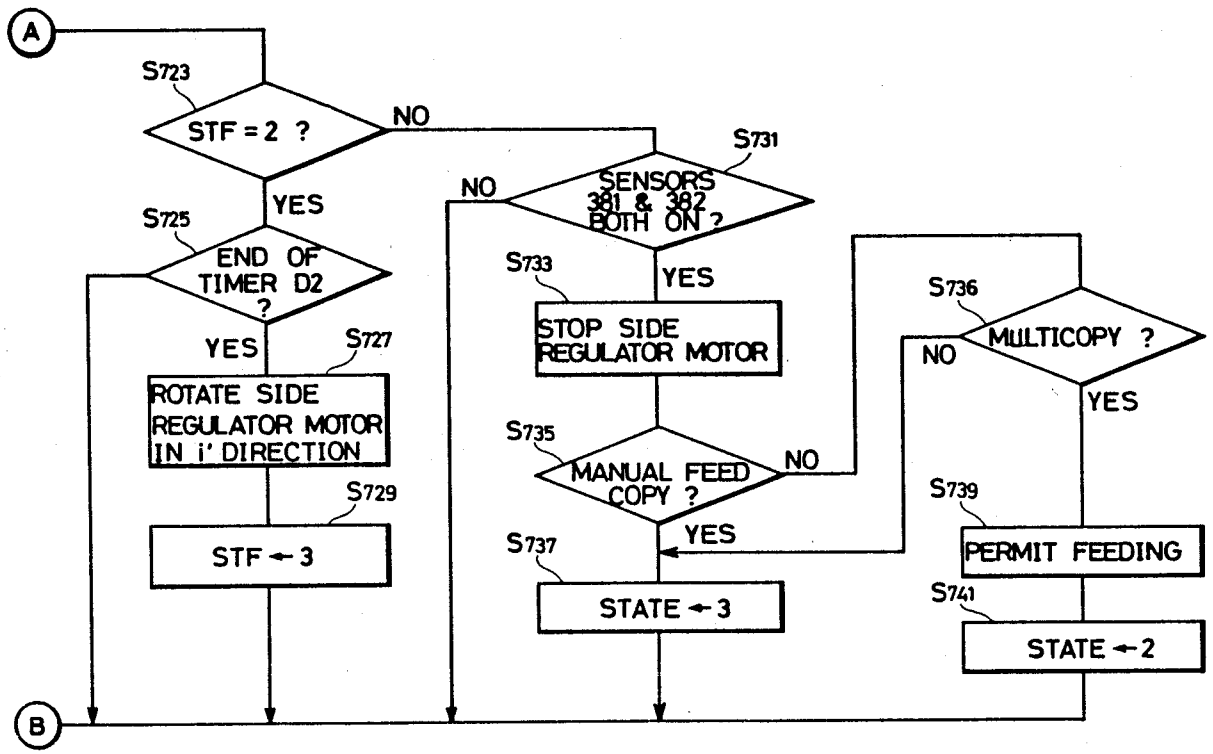

FIGS. 14A and 14B are flow charts showing the first sheet storing routine (in S507 in FIG. 12).

The below described control operation is executed dependent on the STF flag.

The STF flag has the following significances.

STF =0 corresponds to a period until a leading edge of the first sheet of copy paper is in contact with the sensor 60 (as shown in FIGS. 1 and 2).

STF =1 corresponds to a period in which the first sheet of copy paper is passing on the sensor 60.

STF =2 corresponds to a period until an end of a timer D2 after the trailing edge of the first sheet of copy paper has left the sensor 60.

STF =3 corresponds to a period until completion of feeding of the next sheet of copy paper after the end of the timer D2.

First, when the leading edge of the first sheet of copy paper is detected by the sensor 60 provided in the transport block II of the paper refeed unit (in the case of YES in S703), a timer D1 is started (S705) and the STF flag is set to 1 (in S707). The timer D1 is set to a period required for copy paper to be transported by a distance corresponding to the shorter side (182 mm) of the B5 size.

Then, if the timer D1 comes to an end (in the case of YES in S719) while the detection of passage of the copy paper by the sensor 60 continues (in the case of NO in S711), the back regulator plate drive motor is rotated to start movement of the back regulator plate 65 in the direction g' (as shown in FIG. 3) (in S721). This means that the back regulator plate 65 starts to move from the home position if a dimension in the feeding direction of the copy paper to be stored in the refeed tray 58 is longer than the shorter side (182 mm) of the B5 size. In this case, the moving speed of the back regulator plate 65 is set equal to the transport speed of the copy paper in the transport block II.

On the other hand, if the sensor 60 detects passing of the trailing edge of the copy paper (in the case of YES in S711), the back regulator plate drive motor is turned off (in S713) if this drive motor has been turned on (in S721). Thus, the back regulator plate 65 is moved from the home position in the direction g' by a distance of the copy paper exceeding the shorter side (182 mm) of the B5 size. Then, the timer D2 is started (in S715) and the STF flag is set to 2 (in S717).

When the timer D2 started in S715 comes to an end (in the case of YES in S725), the side regulator plates 62 and 63 start to move in the direction h' (in the direction decreasing the distance therebetween as shown in 5) (in S727) and the STF flag is set to 3. In this case, the timer D2 is set to a value sufficient to enable the trailing edge of the copy paper having passed the sensor 60 to be stored in the refeed tray 58. Accordingly, after the copy paper has been stored in the refeed tray 58, the side regulator plates start to move in the direction h' as described above.

When the sensors 381 and 382 are both turned on (in the case of YES in S731) by the movement of the side regulator plates 62 and 63 in the direction decreasing the distance therebetween, the side regulator drive motor is stopped (in S733). The state in which both of the sensors 381 and 382 are turned on is a state in which the side regulator plates 62 and 63 are in contact with both sides of the copy paper in the refeed tray 58 and the copy paper 81 is set in the central position to be set by means of those side regulator plates. Therefore, it is not necessary to further drive the side regulator plates.

After the positioning of the copy paper by the side regulator plates, the processing flow proceeds to the step S735 to determine whether the copy on the stored copy paper is a copy using paper fed from the manual feed opening or not.

If it is the copy using the manually fed paper, the state counter is set to 3 (in S737) to call the paper refeed routine (in S513 in FIG. 12). This is because the size of the first sheet of copy paper manually fed from the manual feed opening and that of the second or subsequent sheet of copy paper also fed manually are not always the same. Therefore, the paper refeed routine is called each time a sheet of copy paper fed is stored in the refeed tray 58.

If the multicopy mode is not set (in the case of NO in S736) even if it is determined in S735 that copy using manually fed paper is not selected, the paper refeed routine is immediately called (in S737). The multicopy mode is a mode in which the number of copies is set by using the ten-key group 80 and copy operation is effected consecutively for the set number by one operation of the print key 79.

If the paper stored is fed normally (from the upper feed tray or the lower feed tray) in the multicopy mode (in the case of YES in S736), feeding of the second or subsequent sheet of copy paper is permitted (in S739) and the state counter is set to 2 (in S741), whereby the storing routine is called.

Figure 15:
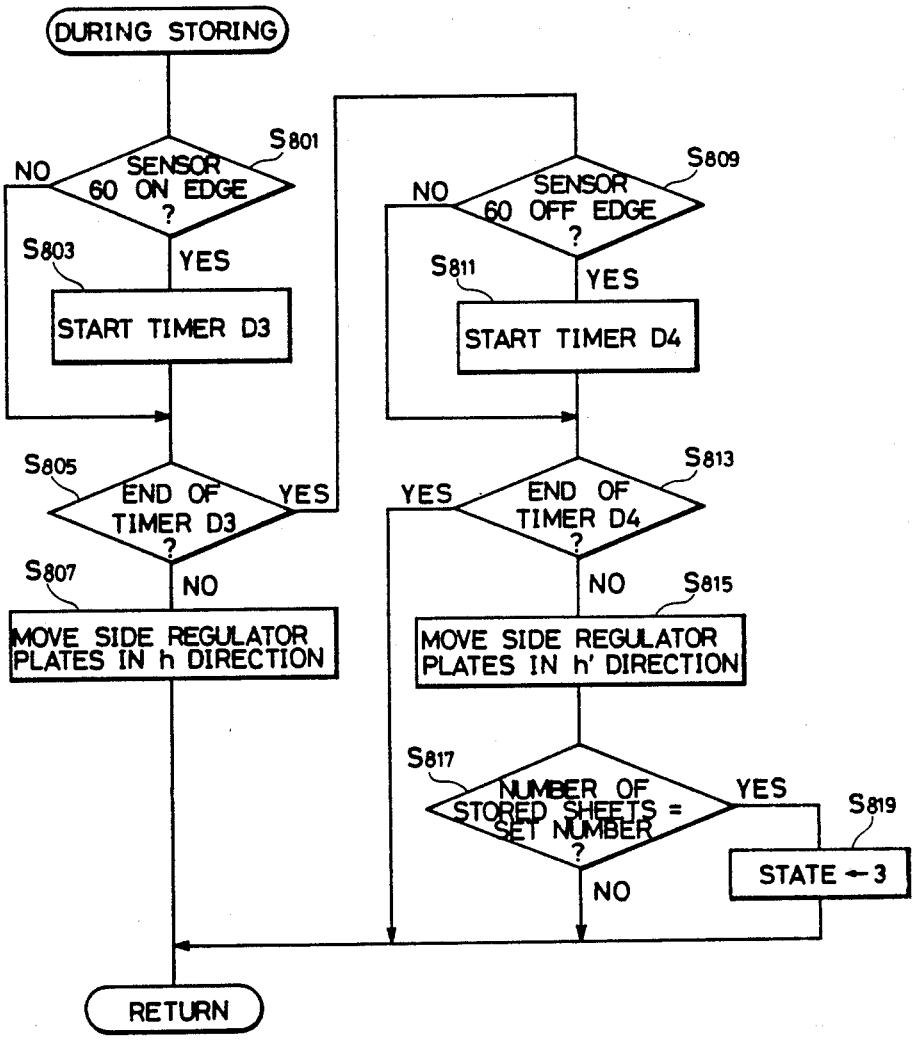
FIG. 15 is a flow chart showing concrete procedures during storing shown in FIG. 12.

FIG. 15 is a flow chart showing the storing routine (in S511 in FIG. 12).

This subroutine is processing for storing the second and subsequent sheets of copy paper in the case of performing duplex copy in the multicopy mode.

More specifically, when a leading edge of the second or subsequent sheet of copy paper is detected by the sensor 60 (in the case of YES in S801), a timer D3 is started (in S803). While the timer D3 does not come to an end (in the case of NO in S805), the side regulator plates are moved in the direction h (as shown in FIG. 5) (in S807). In this routine, the timer D3 is set to a period required for the regulator plates to move by 5 mm. Accordingly, when the timer D3 comes to the end (in the case of YES in S805), the regulator plates stop at positions moved by 5 mm each in the direction h. The above described setting of the timer D3 is made for the purpose of allowing margins for introducing the second or subsequent sheet of copy paper into the refeed tray 58 (as shown in FIG. 8).

When the timer D3 comes to the end and passage of the trailing edge of the second or subsequent sheet of copy paper is detected by the sensor 60 (in the case of YES in S809), a timer D4 is started (in S811). While the timer D4 does not come to an end (in the case of NO in S813), the side regulator plates are moved in the direction h' (as shown in FIG. 5). In this routine, the timer D4 is set to a period required for the regulator plates to move by 5 mm. Accordingly, when the timer D4 comes to the end (in the case of YES in S813), the regulator plates are returned to the positions moved by 5 mm in the direction h', that is, the initial positions fixed by the first sheet of copy paper. Thus, the sheet of copy paper stored this time and the sheet of copy paper already stored are registered at the central position as shown in FIG. 7.

Then, it is determined (in S817) whether the number of sheets of copy paper stored in the refeed tray coincides with the number of copies set on the operation panel of the copying apparatus. If those numbers do not coincide, the processing flow returns to the duplex copy control routine to repeat the storing routine.

On the other hand, if it is determined in S817 that the number of sheets of copy paper stored in the refeed tray coincide with the number of copies set on the operation panel, the state counter is set to 3 (in S819) and the paper refeed routine is called.

Figure 16:
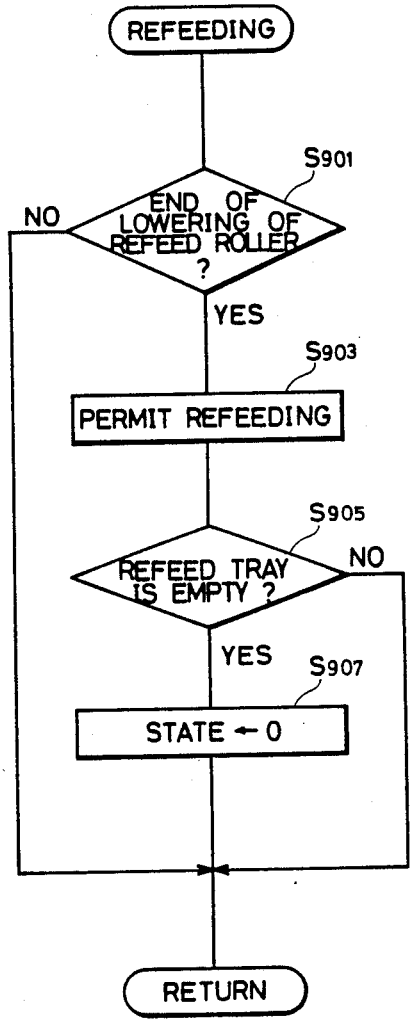
FIG. 16 is a flow chart showing concrete procedures of refeeding shown in FIG. 12.

FIG. 16 is a flow chart showing the refeed routine (in S513 in FIG. 12).

More specifically, there is a wait for completion of lowering of the refeed roller 38 (YES in S901) and then refeed from the paper refeed tray is permitted (in S903).

Further, after all the sheets of copy paper stored in the paper refeed tray have been refed (in the case of YES in S905), the state counter is reset to 0 (in S907) so that the apparatus is prepared for a subsequent duplex copy process.

Thus, the procedures for controlling the apparatus of the present embodiment are executed.

Although paper feeding from a universal cassette (capable of storing sheets of copy paper of various sizes) was not mentioned in the foregoing, the same processing as in the case of using the manual feed opening may be applied.

In addition, in the foregoing description of the embodiment, description of control of the regulator plates in the composite copy mode was omitted, because the same processing as in the case of the duplex copy mode can be applied.

As described in the foregoing, the image forming apparatus according to the present invention is capable of refeeding, to the image forming portion, paper having one surface containing a copy image temporarily stored in the paper refeed tray, thereby to form an image on that surface or the opposite surface of the paper and this image forming apparatus comprises the size detection means for directly detecting a size of paper fed to the image forming portion to change an area of the paper storing portion of the paper refeed tray based on the size detected by this means.

As described in detail in connection with the embodiment, since detection of paper size is directly made as to paper fed, the present invention ensures a high precision of size detection and it is not necessary to provide individual side detection mechanisms for the respective cassettes.

Accordingly, an area of the paper storing portion can be set suitably and the number of components can be reduced.

In addition, in such cases as copy using manually fed paper, in which the size of paper could not be detected in the prior art, the size of the manually fed paper can be detected according to the present invention and thus duplex copy and composite copy can be effected by using manually fed paper.

In addition, in the multicopy mode, positioning of the regulator members with respect to the second and subsequent sheets of paper is controlled based on a position of the regulator members with respect to the first sheet of paper and, consequently size detection of the second and subsequent sheets of paper is not required.

Further, in the multicopy mode, after completion of preparation for positioning the regulator members with respect to the first sheet of paper, the second and subsequent sheets of paper are stored and, accordingly, the time for feeding the first sheet and the second and subsequent sheets of paper can be suitably controlled.

In addition, when sheets of copy paper are consecutively fed manually, feeding of the subsequent sheet does not occur until an end of image processing on the previously fed sheet, and thus paper jam never occurs in the paper refeed tray.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An image forming apparatus which feeds to a paper refeed tray and stores therein, paper having one surface where an image is formed by an image forming portion and refeeds the paper from said paper refeed tray to said image forming portion to form an image on the same surface or the opposite surface of said paper, comprising:

regulation means for regulating edges of paper stored in said paper refeed tray, said regulation means having regulator members movable in opposite directions toward and away from the stored paper, drive means for moving said regulator members in the opposite directions, detection means provided in said regulator members for detecting contact of each said regulator member with an edge of paper stored in said paper refeed tray to generate a signal, and control means for moving said regulator members away from said paper refeed tray at the time of storing paper in said paper refeed tray, moving said regulator members toward the paper after the paper is stored, and stopping said regulator members in response to the signal from said detection means.

2. An image forming apparatus in accordance with claim 1, wherein said regulator members have registration surfaces to be in contact with side edges of the paper, thereby to register the paper stored in said paper refeed tray and said regulator members are movable oppositely in a direction perpendicular to a paper feeding direction.

3. An image forming apparatus in accordance with claim 2, wherein said detection means has an actuator provided rotatably on the registration surface of each said regulator member and a generator for detecting rotation of said actuator to generate a detection signal, said actuator contacts a side edge of paper and rotates by movement of the corresponding regulator member toward the paper.

4. An image forming apparatus for consecutively performing image forming operation for a designated number of sheets of paper in a paper refeed mode in which paper having a first image formed by an image forming portion is stored in a paper refeed tray and refed therefrom to the image forming portion for forming a second image on said paper, thereby to form the first image on a plurality of sheets of paper and to subsequently form the second image on said plurality of sheets of paper, comprising:

regulation means for regulating edges of paper stored in said paper refeed tray, said regulation means having regulator members movable in opposite directions toward and away from paper stored, drive means for moving said regulator members in the opposite directions, detection means for detecting contact of each said regulator member with an edge of paper stored in said paper refeed tray and generating a detection signal, and control means for moving said regulator members away from said paper refeed tray at the time of storing a first sheet of paper in said paper refeed tray, moving said regulator members toward the paper after the first sheet of paper is stored, and stopping said regulator members in response to the detection signal from said detection means, and controlling said regulator members based on the positions of said regulator members with respect to said first sheet of paper at the time of storing second and subsequent sheets of paper in said paper refeed tray.

5. An image forming apparatus in accordance with claim 4, wherein said control means moves said regulator members by a small amount to outside from regulated positions of storage of said first sheet of paper to bring said regulator members in a waiting state before the second or subsequent sheet of paper is stored in said paper refeed tray, and returns said regulator members to said regulated positions of storage after the second or subsequent sheet has been stored.

6. An image forming apparatus in accordance with claim 5, wherein said regulator members have registration surfaces to be in contact with side edges of the paper, thereby to register the paper stored in said paper refeed tray and said regulator members are movable oppositely in a direction perpendicular to a paper feeding direction.

7. An image forming apparatus in accordance with claim 6, wherein said detection means has an actuator provide rotatably on the registration surface of each said regulator member and a generator for detecting rotation of said actuator and generating a detection signal, said actuator contacts a side edge of paper and rotates by movement of the corresponding regulator member toward the paper.

8. An image forming apparatus for consecutively performing image forming operation for a designated number of sheets of paper in a paper refeed mode in which paper having a first image formed by an image forming portion is stored in a paper refeed tray and refed therefrom to said image forming portion for forming a second image on said paper, thereby to form the first image on a plurality of sheets of paper and to subsequently form the second image on said plurality of sheets of paper, comprising:

size detection means for detecting a size of paper stored in said paper refeed tray directly from said paper, paper regulator members for setting paper to be stored at a predetermined position in said paper refeed tray, drive control means for controlling movement of said paper regulator members to set paper at said predetermined position according to the paper size detected by said detection means at the time of storing a first sheet of paper in said paper refeed tray and positioning second and subsequent sheets of paper based on a position of said first sheet of paper set at said predetermined position at the time of storing the second and subsequent sheets of paper in said paper refeed tray, and forbidding control means for forbidding storing of the second sheet of paper in said paper refeed tray until completion of preparation for setting the first sheet of paper at said predetermined position.

9. An image forming apparatus in accordance with claim 8, wherein said forbidding control means sets time of completion of storage of the first sheet in said paper refeed tray to time of said completion of preparation for the positioning.

10. An image forming apparatus in accordance with claim 9, wherein said paper regulator members include a first regulator plate for regulating paper in a paper feeding direction and two second regulator plates for regulating the paper in a direction perpendicular to said paper feeding direction, said size detection means includes two contact detection means for detecting contact of said two second regulator plates with the paper, to detect a dimension of paper in the direction perpendicular to the paper feeding direction, and said drive control means moves said second regulator plates toward the paper and stops the movement of said second regulator plates in response to an output of detection of the contact with the paper by said two contact detection means.

11. An image forming apparatus in accordance with claim 10, wherein said image forming apparatus comprises paper transport paths through which paper to be stored in said paper refeed tray passes, said size detection means includes time detection means provided in said paper transport paths, for detecting a paper detection start time indicating a start of passage of the paper and a paper detection end time indicating an end of passage of paper, thereby to detect a dimension of paper in the paper feeding direction, and said drive control means moves said first regulator plate in the direction opposite to the paper feeding direction at a speed equal to a paper passing speed until said paper detection end time has passed after an elapse of a predetermined period from said paper detection start time detected by said time detection means.

12. An image forming apparatus for consecutively performing image forming operation for a designated number of sheets of paper in a paper refeed mode in which paper having a first image formed by an image forming portion is stored in a paper refeed tray and refed therefrom to said image forming portion for forming a second image on said paper, thereby to form the first image on a plurality of sheets of paper and to subsequently form the second image on said plurality of sheets of paper, comprising:

size detection means for detecting a size of paper stored in said paper refeed tray directly from said paper, paper regulator members for locating paper to be stored in a predetermined position in said paper refeed tray, drive control means for controlling movement of said paper regulator members to set paper in said predetermined position according to the paper size detected by said size detection means, manual feed means for manually feeding paper to said image forming portion for forming said first image thereon, and forbidding control means for forbidding feeding of subsequent sheets of paper by said manual feed means until the second image has been formed on the previously fed sheet of paper when feeding of paper from said manual feed means is consecutively effected in said paper refeed mode.

13. An image forming apparatus in accordance with claim 12, wherein said paper regulator members include a first regulator plate for regulating paper in a paper feeding direction and two second regulator plates for regulating the paper in a direction perpendicular to said paper feeding direction, said size detection means includes two contact detection means for detecting contact of said two second regulator plates with the paper, to detect a dimension of paper in the direction perpendicular to the paper feeding direction, and said drive control means moves said second regulator plates toward the paper and stops the movement of said second regulator plates in response to an output of detection of the contact with the paper by said two contact detection means.

14. An image forming apparatus in accordance with claim 13, wherein said image forming apparatus comprises paper transport paths through which paper to be stored in said paper refeed tray passes, said size detection means includes time detection means provided in said paper transport paths, for detecting a paper detection start time indicating a start of passage of the paper and a paper detection end time indicating an end of passage of paper, thereby to detect a dimension of paper in the paper feeding direction, and said drive control means moves said first regulator plate in the direction opposite to the paper feeding direction at a speed equal to a paper passing speed until said paper detection end time has passed after an elapse of a predetermined period from said paper detection start time detected by said time detection means.

* * * * *